United States Patent [19]

Freed, Jr. et al.

[11] 4,310,199

[45] Jan. 12, 1982

[54] CUTTER DRUM ASSEMBLY FOR A CONTINUOUS MINING MACHINE

[75] Inventors: Donald L. Freed, Jr.; Gerald L. Baum, both of Belleville, Ill.

[73] Assignee: National Mine Service Company, Pittsburgh, Pa.

[21] Appl. No.: 77,328

[22] Filed: Sep. 20, 1979

[51] Int. Cl.[3] ..... E21C 27/24

[52] U.S. Cl. ..... 299/76; 299/89

[58] Field of Search ..... 299/76, 78, 87, 89, 299/75

[56] References Cited

U.S. PATENT DOCUMENTS

| | | | |
|---|---|---|---|
| Re. 28,310 | 1/1975 | Krekeler | 299/93 |
| 2,751,204 | 6/1956 | Sibley | 299/76 X |
| 2,758,826 | 8/1956 | Paget | 299/89 X |
| 2,932,496 | 4/1960 | Barrett | 299/78 X |
| 3,290,096 | 12/1966 | Stalker | 299/78 |
| 3,307,880 | 3/1967 | Newton et al. | 299/75 |
| 3,773,384 | 11/1973 | Anderson | 299/76 |
| 3,774,969 | 11/1973 | Lebegue | 299/76 |

*Primary Examiner*—Ernest R. Purser

*Attorney, Agent, or Firm*—Stanley J. Price, Jr.; John M. Adams

[57] ABSTRACT

A continuous mining machine includes a body portion mounted on endless tracks and a boom member extending forwardly from the body portion with a cutter drum member rotatably mounted on the front end of the boom member. The cutter drum member has an intermediate drum section and a pair of end drum sections. A pair of driven input shafts are drivingly connected to the pair of end drum sections respectively. Intermediate drive shafts extend from the end drum sections into the ends of the intermediate drum section. The intermediate drum section is formed by a pair of releasably connected housing sections. A connecting plate is positioned within and nonrotatably secured to each housing section. Each connecting plate includes planar faces that engage corresponding planar faces provided on the end of the respective intermediate drive shaft. With the intermediate drum sections assembled on the drive shafts, the connecting plates are nonrotatably connected to the drive shafts to transmit rotation from the drive shafts to the housing sections to rotate the intermediate drum section. Pairs of connecting plates are releasably connected to one another surrounding the drive shafts to facilitate efficient assembly and disassembly of the intermediate drum section.

15 Claims, 13 Drawing Figures

CUTTER DRUM ASSEMBLY FOR A CONTINUOUS MINING MACHINE

BACKGROUND OF THE INVENTION

1. Field of the Invention

This invention relates to a continuous mining machine and more particularly to a mining machine having a cutter drum assembly that includes an intermediate drum section positioned between a pair of end drum sections in which the intermediate drum section is non-rotatably connected to drive shafts in a manner to facilitate efficient assembly and disassembly thereon.

2. Description of the Prior Art

Continuous mining machines, as illustrated in U.S. Pat. No. 3,774,969, are utilized in underground mining operations to continuously dislodge solid mineral material from the face of a mine shaft. Generally, a boom member extends forwardly from an elongated body portion of the mining machine that is propelled through the mine on endless crawler tracks. The boom member is pivotally connected to the mining machine body portion and rotatably supports a cutter drum assembly having peripherally extending cutting elements. The cutter drum assembly extends transversely to the longitudinal axis of the body portion and upon rotation, the cutting elements dislodge solid material from the mine face.

The cutter drum assembly is raised to a preselected vertical height in the mine as determined by the thickness of the mineral seam. The cutter drum assembly is rotated and sumped into the mine face with the cutter drum assembly positioned adjacent the mine roof. Once the cutter drum assembly has advanced into the mine face, the boom member is pivoted downwardly to move the cutter drum assembly vertically downwardly through the face to make a shear cut in the face. The dislodged material is gathered by a gathering device which moves the dislodged material rearwardly onto a conveyor that extends longitudinally on the mining machine to transport the material toward the rear of the mining machine. By dislodging mineral material from the mine face in this manner a mine passageway or room is formed to thus permit the mining machine to advance and continuously dislodge material from the mine face.

It is the conventional practice to position the cutting elements on the periphery of the cutter drum assembly in a continuous screw-type pattern. The material dislodged by the cutting elements is also conveyed by the cutting elements inwardly from the end drum sections to the center of the intermediate drum section and fed onto the gathering device. Each of the cutting elements includes a cutter bit positioned in a bit holder which is supported by a bit block.

The bit block may be mounted on the periphery of the cutter drum in a number of ways, such as by welding the bit block to the surface of the cutter drum. In this manner the cutting elements are permanently affixed to the cutter drum. However, the cutter bits are subject to wear and breakage, thereby requiring frequent replacement which may be required on a daily basis. Therefore, to facilitate the replacement of broken cutter bits removable retaining means, as disclosed in U.S. Pat. No. Re. 28,310, have been developed for securing the cutter bits in the bit holder so that the bits can be quickly installed or removed and replaced.

Not only are the cutter bits subject to failure but the bit holder and the bit block as well. Because the bit holder and block of each cutting element are subject to the stresses of the cutting action, it is not unusual to require their replacement on a weekly basis. Since the bit block is usually welded to the cutter drum assembly its replacement is difficult. It is the conventional practice when possible to replace a bit block by welding in the field. Frequently, however, it is necessary to remove the mining machine from service in the mine and take it to a place where repairs can be made. Both of these methods of replacing a bit block are time consuming and result in considerable downtime for the mining machine. Consequently, repair of broken bit blocks or bit holders is postponed until the efficiency of the mining machine is diminished to the point where the mining machine can no longer function properly without making the necessary repair.

One alternative to removing the mining machine from its place of operation in the mine in order to replace broken bit blocks is disassembly of the required portion of the cutter drum housing and installation of a replacement housing at the location of operation of the mining machine. This avoids the delays encountered when the machine is moved from the mine face to a repair point remote from the face. However, with the known continuous mining machines as above described and also disclosed in U.S. Pat. Nos. 2,758,826; 3,290,096 and 3,773,384 the intermediate and end drum sections are formed by a cylindrical casing or shell providing a hollow cavity into which the drum drive shafts extend. Removing the cylindrical shell is difficult, particularly when the mining machine is positioned at the mine face where there is limited space available to disassemble the cutter drum. Also, with known cutter drums when disassembled the bearing seals are exposed and the lubricant is lost.

One solution suggested to this problem is disclosed in U.S. Pat. No. 3,307,880 in which the cutter bits are carried in a bit holder which is in the form of split ring sections. The split ring sections are bolted together and clamped onto the periphery of the cutter drum. This arrangement permits the removal and replacement of the split ring sections without removing other parts of the cutter drum for sharpening dull bits and replacing damaged bit holders. However, the housing of the cutter drum is not adapted for efficient dismantling.

There is need for a continuous mining machine having a cutter drum assembly which is readily assembled and disassembled for repair of broken cutting elements on the periphery of the cutter drum so the continuous mining machine may remain at its place of operation in the mine and thus reduce the downtime for repairing the broken cutting elements. While it has been suggested to provide a replacable cutting elements on the periphery of the cutter drum, the prior art devices do not provide a cutter drum assembly that is capable of being efficiently disassembled at its location of operation without considerable difficulty and without exposing the bearing seals to possible damage.

SUMMARY OF THE INVENTION

In accordance with the present invention there is provided a continuous mining machine that includes a body portion and propelling means supporting the body portion for advancing the body portion. A boom member is pivotally secured to the body portion and extends forwardly therefrom. A drum member is rotatably mounted on the front of the boom member transversely to the body portion. The drum member has cutting elements extending therefrom. The cutting elements are arranged on the drum member to provide a continuous cutting pattern along the length of the drum member. The drum member has an intermediate drum section and a pair of end drum sections. The pair of end drum sections extend outwardly from the ends of the intermediate drum section respectively. Drive means extends from the body portion for rotating the drum member. The drive means is nonrotatably connected to the pair of end drum sections. Intermediate drum drive means extends from the end drum sections into the intermediate drum section. Means is provided for rotatably supporting the intermediate drum drive means axially in the intermediate drum section. The intermediate drum section includes a pair of housing sections positioned in surrounding relation with the intermediate drum drive means. Means is provided for releasably joining together the pair of housing sections in assembled relation around the intermediate drum drive means. Drum connecting means secured to the pair of housing sections drivingly connects the pair of housing sections to the intermediate drum drive means. The drum connecting means is releasably positioned on the intermediate drum drive means to transmit rotation from the intermediate drum drive means to the intermediate drum section.

The drive means includes a pair of input drive shafts extending through openings between the intermediate section and the pair of end drum sections respectively. Rotation is transmitted from the input drive shafts to the end drum sections and therefrom to the intermediate drum drive means which includes intermediate drive shafts that extend from each end drum section into opposite ends of the intermediate drum section. Each intermediate drive shaft has a first end portion drivingly connected to a respective end drum section and a second end portion nonrotatably connected to the intermediate drum section. The shaft second end portion includes a plurality of planar faces arranged at right angles around the periphery of the intermediate drive shaft.

The drum connecting means is nonrotatably secured to the planar faces of the intermediate drive shafts. The drum connecting means includes a plurality of connected pairs of plate members adapted to nonrotatably engage the planar faces of the intermediate drive shafts. Each plate member includes an arcuate surface welded to the inner surface of one of the respective drum housing sections and an opposite right-angled surface formed by a pair of intersecting planar faces. The intersecting planar faces are adapted for positioning in overlying, abutting relation with corresponding planar surfaces on the second end portion of the intermediate drive shaft.

The intermediate drum housing sections are positioned around the intermediate drive shafts so that the connecting plates of one drum section abut the connecting plates of the other drum section to form pairs of connecting plates surrounding the intermediate drive shafts. The planar shafts of the connecting plates engage the planar faces of the intermediate drive shafts. The abutting connecting plates are releasably bolted together in surrounding, nonrotatable relation with the intermediate drive shafts.

Rotation of the intermediate drum shafts rotates the connecting plates. With the connecting plates being secured to the respective intermediate drum housing sections, the intermediate drum housing sections are rotated. The intermediate drum housing sections are also releasably connected to one another. Thus this arrangement facilitates efficient assembly and disassembly of the intermediate drum section on the intermediate drive shafts.

Further in accordance with the present invention there is provided a mining machine cutter drum assembly that includes a drum member having cutting elements extending therefrom. The cutting elements are arranged on the drum member to provide a continuous cutting pattern along the length of the drum member. The drum member includes an intermediate section and a pair of end drum sections. The pair of end drum sections extend outwardly from the ends of the intermediate drum section respectively. Drive means for rotating the drum member includes intermediate drum drive means for rotating the intermediate drum section. Means is provided for rotatably supporting the intermediate drum drive means axially in the intermediate drum section. The intermediate drum section includes a pair of housing sections positioned in surrounding relation with the intermediate drum drive means. Means is provided for releasably joining together the pair of housing sections in assembled relation around the intermediate drum drive means. Drum connecting means secured to the pair of housing sections drivingly connects the pair of housing sections to the intermediate drum drive means. The drum connecting means is releasably positioned on the intermediate drum drive means to transmit rotation from the intermediate drum drive means to the intermediate drum section.

Accordingly, the principal object of the present invention is to provide for a continuous mining machine, a cutter drum assembly which is efficiently assembled and disassembled to facilitate repair and maintanance of the cutter drum assembly.

Another object of the present invention is to provide a cutter drum assembly having an intermediate drum section mounted on a drive shaft in a manner permitting the intermediate drum section to be quickly disassembled from driving engagement with the drive shaft.

These and other objects of the present invention will be more completely described and disclosed in the following specification, the accompanying drawings, and the appended claims.

DESCRIPTION OF THE PREFERRED EMBODIMENT

Figure 1:
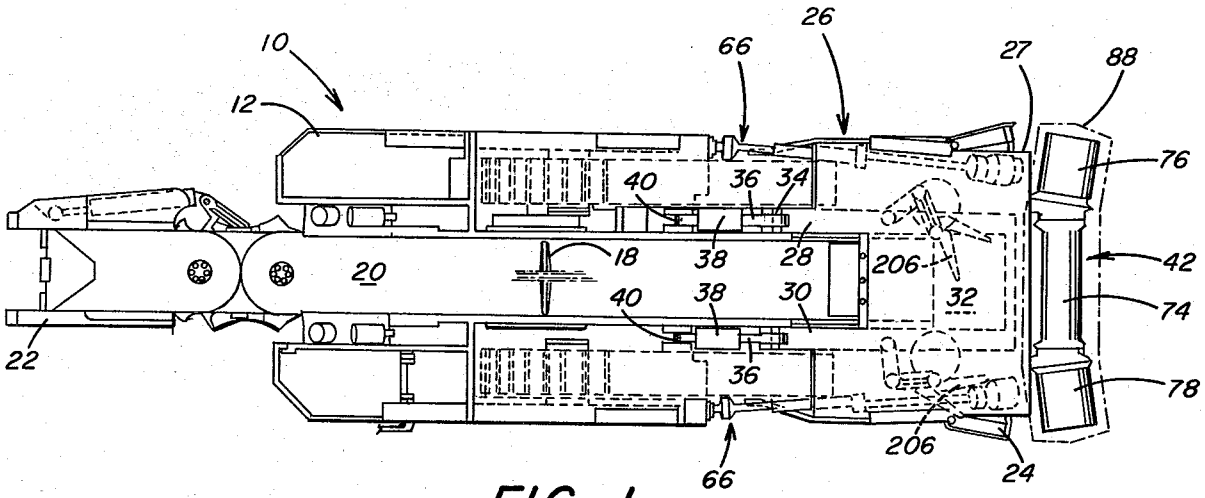
FIG. 1 is a top plan view of the continuous mining machine of the present invention, illustrating a cutter drum assembly extending forwardly at the front of the mining machine.
Figure 2:
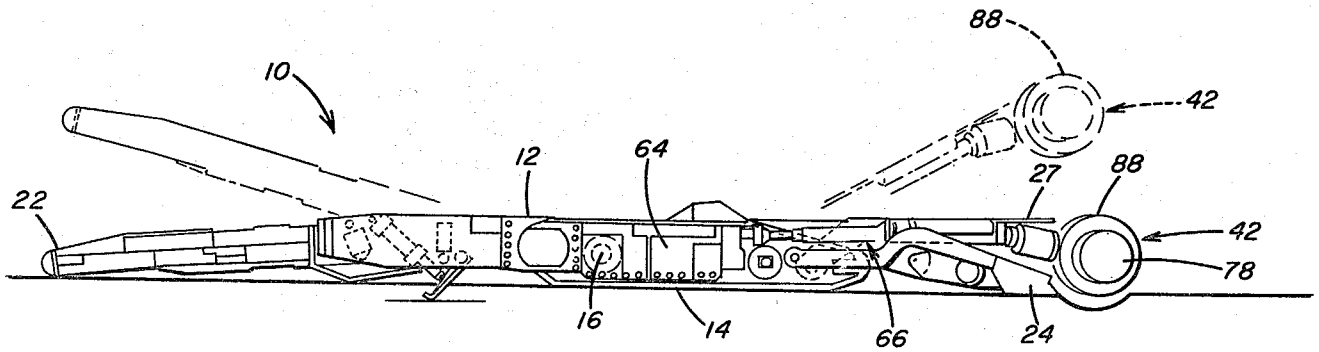
FIG. 2 is a view in side elevation of the continuous mining machine shown in FIG. 1, illustrating the vertical pivotal range of the cutter drum assembly.

Referring to the drawings and particularly to FIGS. 1 and 2 there is illustrated a continuous mining machine generally designated by the numeral 10 that has a body or frame portion 12 suitably mounted on endless crawler tracks 14. Hydraulic motors 16 are provided to propel the mining machine 10 on the endless crawler tracks 14 to advance the mining machine during the mining operation. An endless conveyor mechanism 18 is positioned in a longitudinal trough member 20 and conveys dislodged material therein from the front of the mining machine to an articulated rear discharge section 22. As illustrated in FIG. 2, a gathering device 24 extends forwardly from the body portion 12 and is arranged to gather and feed the dislodged material onto the conveyor trough 20 so that the dislodged material can be conveyed rearwardly by the endless conveyor mechanism 18 to the discharge section 22.

Figures 3, 4:
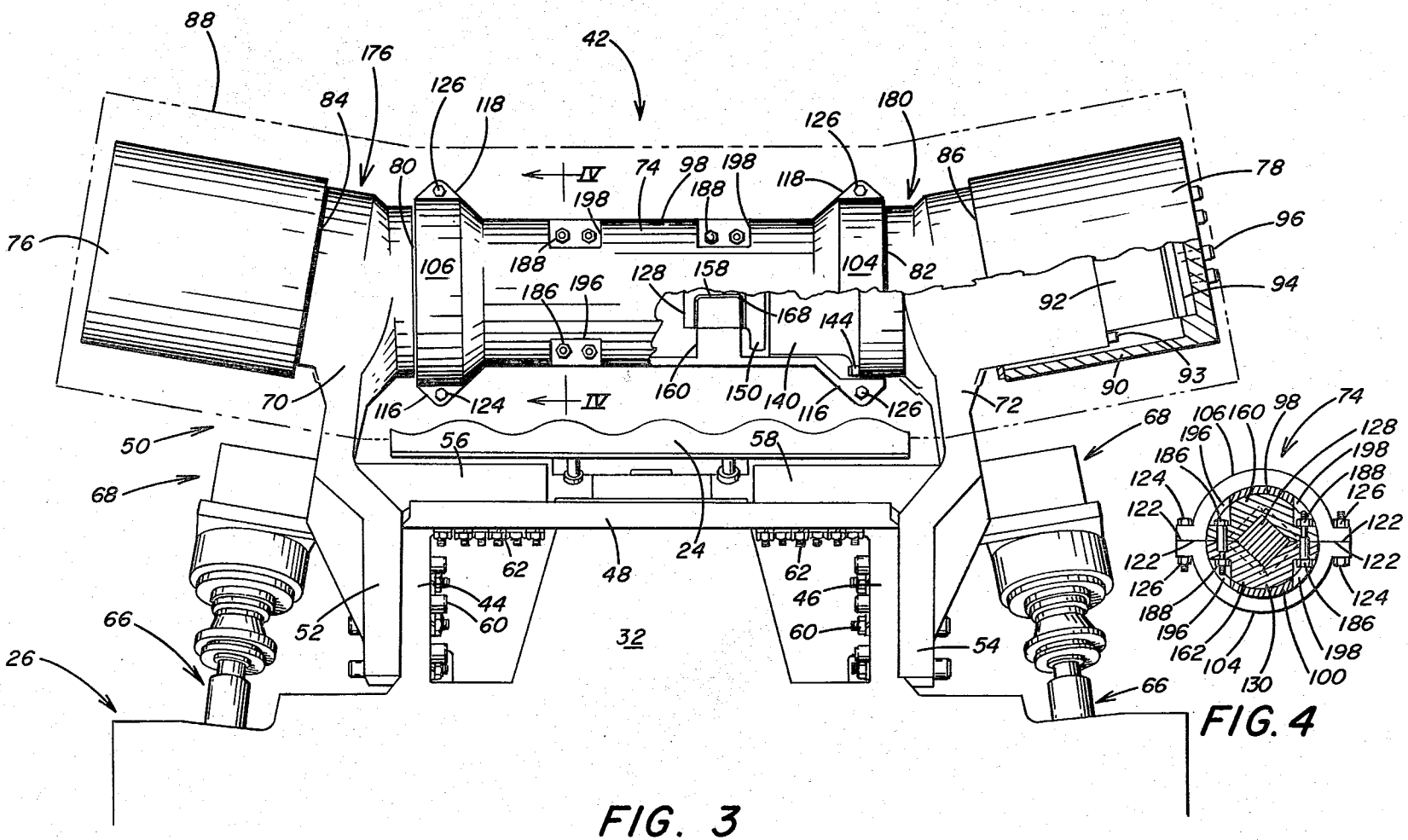
FIG. 3 is an enlarged fragmentary plan view of the cutter drum assembly connected to and extending forwardly from a boom member.
FIG. 4 is a reduced sectional view taken along line IV—IV of FIG. 3 of the cutter drum assembly, illustrating the removable connection of the intermediate drum section to the intermediate drum drive shaft in accordance with the present invention.

As illustrated in FIGS. 1 and 2, and in greater detail in FIG. 3, a boom member generally designated by the numeral 26 extends forwardly from the body portion 12 and as shown in FIGS. 1 and 2 includes a cover plate 27 that extends from the receiving end portion of the conveyor mechanism 18 forwardly therefrom into overlying relation with the front edge of the gathering device 24. As shown in FIG. 1 the boom member 26 includes a pair of parallel rearwardly extending arm members 28 and 30 that are connected at their forward end portions to a housing 32 that extends transversely across the front of the mining machine 10.

Each of the arm members 28 and 30 are pivotally connected at a pivot point 34 to a piston rod 36 of a piston cylinder assembly 38. The pair of piston cylinder assemblies 38 illustrated in FIG. 1 are, in turn, pivotally connected to the mining machine body portion 12 at pivot points 40. With this arrangement the boom arm members 28 and 30 are pivotally connected to the mining machine body portion 12.

Upon extension and retraction of the piston rods 36 and within the piston cylinder assemblies 38, the boom member 26 is operable to pivot about the pivot points 34 of the arm members 28 and 30 to move the boom member 26 vertically to the position illustrated in phantom in FIG. 2. A cutter drum assembly generally designated by the numeral 42 connected to the boom member 26 performs an upward shear cut of the mine face. Also the mining machine 12 is operable to advance into the mine face with the boom member 26 in the upper position, as illustrated in phantom in FIG. 2. The piston cylinder assemblies 38 are operable to pivot the boom member 26 downwardly to the position as illustrated by the solid lines in FIG. 2. In this manner the cutter drum assembly 42 dislodges material from the mine face by a downward shear cut.

The boom member 26 has a second pair of arm members 44 and 46 that extend forwardly from the boom housing 32, as illustrated in FIG. 3. The forward end portions of the arm members 44 and 46 are connected to one another by a transverse support member 48. The cutter drum assembly 42 is supported by a drum housing generally designated by the numeral 50. The drum housing 50 includes a pair of rearwardly extending arm members 52 and 54 which are positioned outboard and abutting the boom arm members 44 and 46 respectively.

The drum housing 50 also includes a pair of laterally extending arm members 56 and 58 that are positioned forwardly of an in abutting relation with the boom member transverse support member 48. The drum housing arm members 52 and 54 are connected to the boom arm members 44 and 46 by a plurality of suitable fastening devices 60. Similarly, the drum housing laterally extending arm members 56 and 58 are connected by a plurality of fastening devices 62 to the transverse support member 48. With this arrangement the cutter drum assembly 42 is connected to the boom member 26.

A pair of cutter drum motors 64, one of which is illustrated in FIG. 2, are mounted on the body portion 12 and are operable to rotate the cutter drum assembly 42, to be described later in greater detail. As illustrated in FIGS. 1 and 3, a drive shaft assembly generally designated by the numeral 66 is drivingly connected to each of the motors 64 and extends forwardly therefrom to a clutch mechanism generally designated by the numeral 68. The clutch mechanisms 68 are mounted on the drum housing 50. The clutch mechanisms 68 connect the motors 64 to the drive gearing for the cutter drum assembly 42.

The drum housing 50 includes nonrotatable angular housing portions 70 and 72 which extend forwardly from the drum housing arm members 52 and 54. The rotatable portions of the cutter drum assembly 42 are mounted on the nonrotatable annular housing portions 70 and 72. The drive means for the cutter drum assembly 42 extend through the annular housing portions 70 and 72 and are connected to gearing within the cutter drum assembly 42 to rotate the cutter drum assembly 42 to dislodge material from the mine face.

The cutter drum assembly 42 has an intermediate drum section 74 and a pair of end drum sections 76 and 78. The intermediate drum section 74 is rotatably supported by the annular housing portion 70 and 72. The end drum section 76, illustrated in FIGS. 1 and 3, is canted with respect to the intermediate drum section 74 and is rotatably supported by the annular housing portion 70. Likewise the end drum section 78 is canted with respect to the intermediate drum section 74 and is rotatably supported by the annular housing portion 72.

The intermediate drum section 74 has outer annular edge portions 80 and 82, and the end drum sections 76 and 78 have inner annular edge portions 84 and 86. The intermediate drum section 74 and the end drum sections 76 and 78 include a plurality of cutting elements that extend peripherally from the respective drum sections. The end drum sections 76 and 78 are positioned so that the bit pattern formed by the row of cutting elements along the inner annular edge portions 84 and 86 overlap the bit pattern of the row of cutter elements along the intermediate drum section outer annular edge portions 80 and 82 along the front of the cutter drum assembly 42. The bit pattern of the respective drum sections divert rearwardly and outwardly along the rear of the cutter drum assembly 42 so at this point the cutting elements of the intermediate drum section 74 are spaced from the cutting elements of the end drum sections 76 and 78.

This arrangement is illustrated in FIGS. 1 and 3 where the individual cutting elements have been eliminated from the respective drum sections for purposes of illustration. The bit pattern formed by the cutting elements is indicated by the line 88. Thus with the above arrangement the cutter drum assembly 42 is operable to dislodge a continuous kerf of material from the mine face without leaving unmined portions in the face. As the cutter drum assembly 42 completes a shear cut in the mine face a relatively horizontal roof and floor are formed in the mine passageway.

Each of the end drum sections 76 and 78 has an identical configuration; therefore, the structure of the end drum section 78 will only be described. As illustrated in FIG. 3, the drum member end section 78 has a cylindrical body portion 90 having the inner annular edge portion 86. A cylindrical bearing housing 92 extends from the annular housing portion 72 into the cylindrical body portion 90. The bearing housing 92 is connected by bolts 93 to the annular housing portion 72. An end drum drive shaft 94 is rotatably supported by the bearing housing 92 within the end drum body portion 90. The end drum drive shaft 94 is suitably connected by drive gearing extending through the annular housing portion 72 to the clutch mechanism 68 and the drive shaft assembly 66. The end drum drive shaft 94 is connected to the body portion 90 by suitable fastening devices 96 to transmit rotation to the body portion 90.

Figure 5:
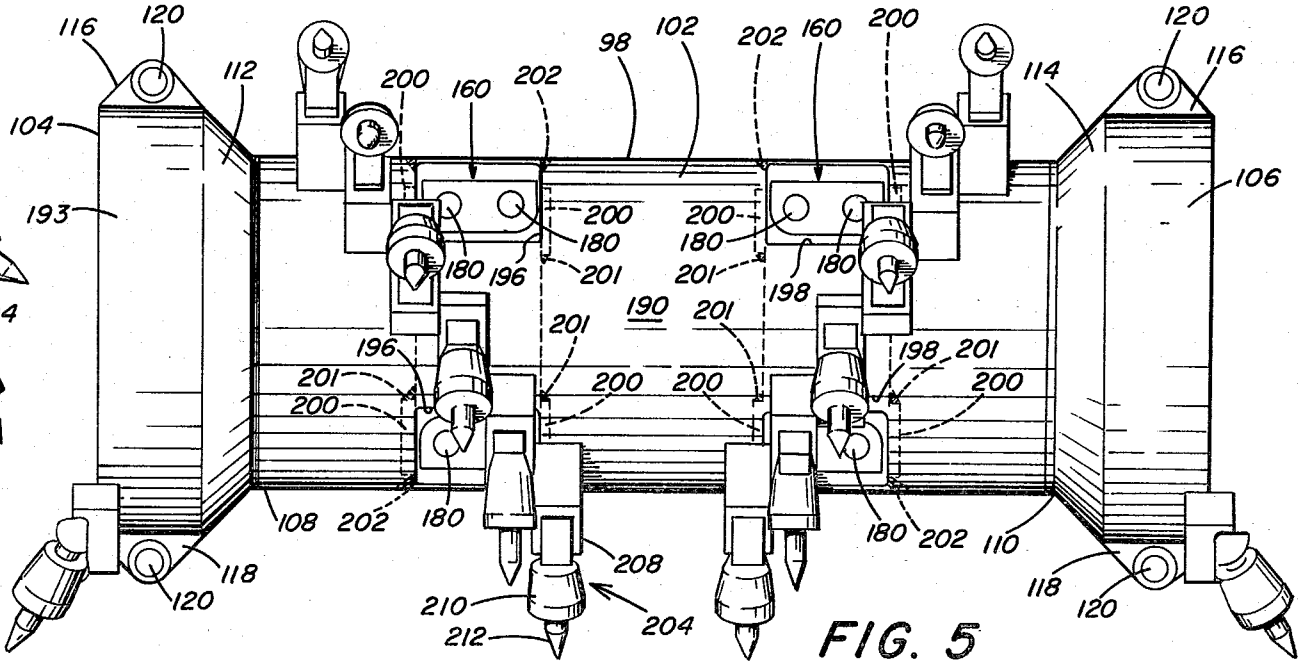
FIG. 5 is a view in side elevation of the first drum housing section of the cutter drum intermediate section, illustrating the scroll pattern of the cutting elements secured to the periphery of the drum housing section.
Figure 6:
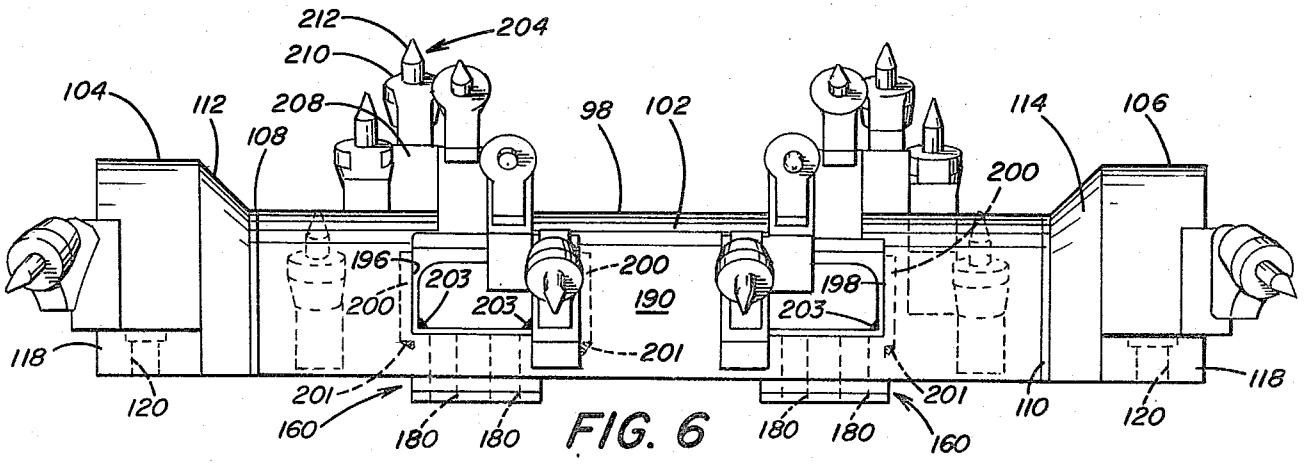
FIG. 6 is a bottom view of the first intermediate drum housing section shown in FIG. 5.
Figure 7:
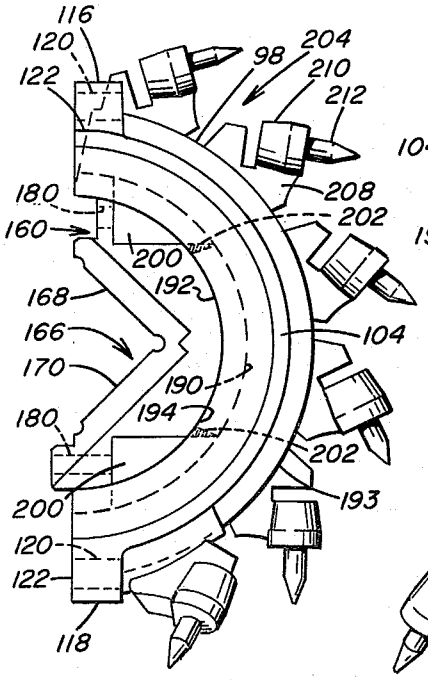
FIG. 7 is an end view of the first intermediate drum housing section shown in FIG. 5, illustrating a connecting plate for nonrotatably securing the first intermediate drum housing section to the intermediate drum drive shaft.
Figure 8:
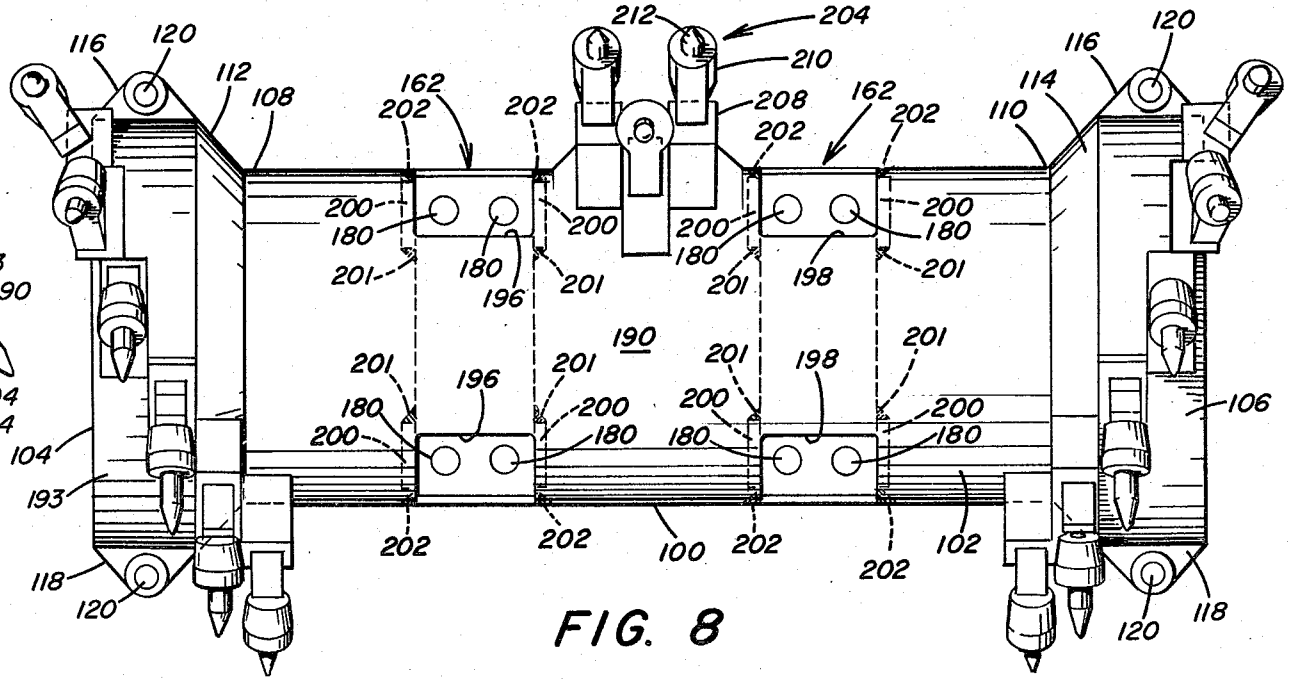
FIG. 8 is a view in side elevation of the second drum housing section of the cutter drum intermediate section which is connected to the first drum housing section shown in FIG. 5, also illustrating cutting elements secured to the periphery of the second drum housing section.
Figure 9:
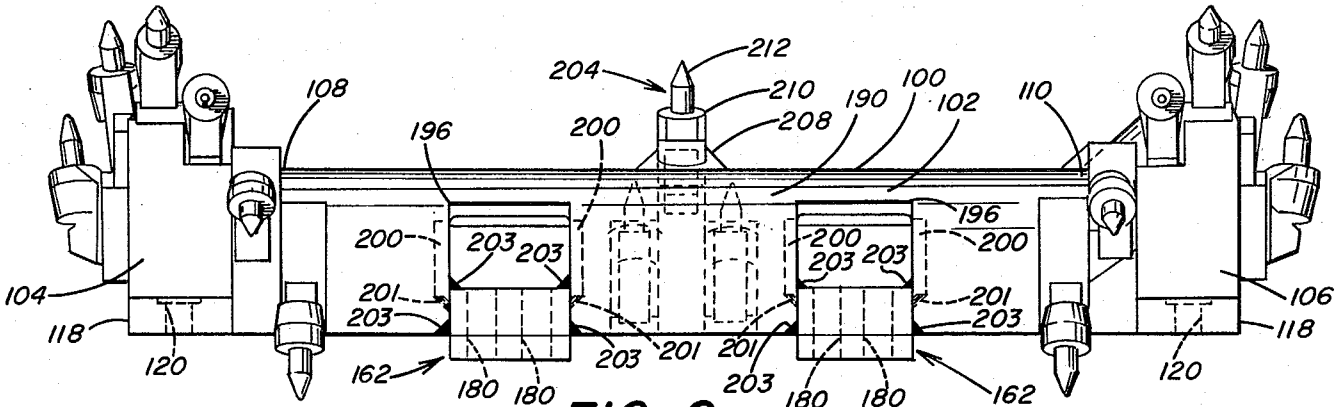
FIG. 9 is a bottom view of the second intermediate drum housing section shown in FIG. 8.
Figure 10:
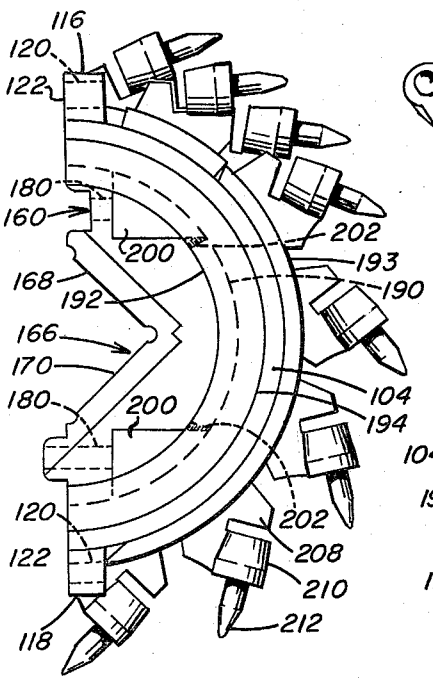
FIG. 10 is an end view of the second intermediate drum housing section shown in FIG. 8, illustrating a connecting plate for nonrotatably securing the second intermediate drum housing section to the intermediate drum drive shaft and also adapted for connection to the connecting plate of the first intermediate drum housing section.

Now referring to FIGS. 4–10 there is illustrated in detail the construction of the intermediate drum section 74. As shown in FIG. 4, the intermediate drum section generally designated by the numeral 74 is formed by a pair of drum housing sections 98 and 100. The drum housing section 98 is illustrated in FIGS. 5–7, and the drum housing section 100 is illustrated in FIGS. 8–10. Each of the drum housing sections 98 and 100 is formed by a center portion 102 suitably connected, as by welding, to a pair of flared end portions 104 and 106.

The center portion 102 of each drum housing section 98 and 100 has a seamless semicircular configuration, as illustrated in FIGS. 7 and 10 and includes end portions 108 and 110. The end portions 108 and 110 are welded to end portions 112 and 114, respectively, of the flared end portions 104 and 106. Each of the flared end portions 104 and 106 has flanges 116 and 118 that extend outwardly from opposite sides of the respective flared end portion. Each of the flanges 116 and 118 has a bore 120 extending therethrough and an abutment face 122, shown in FIGS. 7 and 10.

With this arrangement when the drum housing sections 98 and 100 are positioned in assembled relation, as illustrated in FIG. 4, the abutment faces 122 are positioned in abutting relation so that the bores 120 are aligned to receive bolts 124. Nut 126 are threaded onto the ends of the bolts 124 to secure together the drum housing sections 98 and 100 to form the intermediate drum section 74. Thus, with this arrangement the intermediate drum section 74 is easily assembled and disassembled for repair of the intermediate drum section, as for example for repairing or replacing broken cutting elements on the intermediate drum section 74.

Further as illustrated in FIG. 4, the assembled intermediate drum housing sections 98 and 100 are nonrotatably connected to an intermediate drive shaft 128 that extends through the flared end portions 104 and 106 from the respective end drum sections 76 and 78. One of the intermediate drive shafts 128 is shown in FIG. 4. The connection of the intermediate drive shaft 128 to the drum housing sections 98 and 100 is accomplished by a drum connecting assembly generally designated by the numeral 130 in FIG. 4. The intermediate drive shaft 128, shown in FIG. 4, extending from the end drum section 76 is identical to intermediate drive shaft 128, shown in FIGS. 3 and 11, extending from the end drum section 78. The pair of intermediate drive shafts 128 extend into the ends of the intermediate drum section 74.

Figure 11:
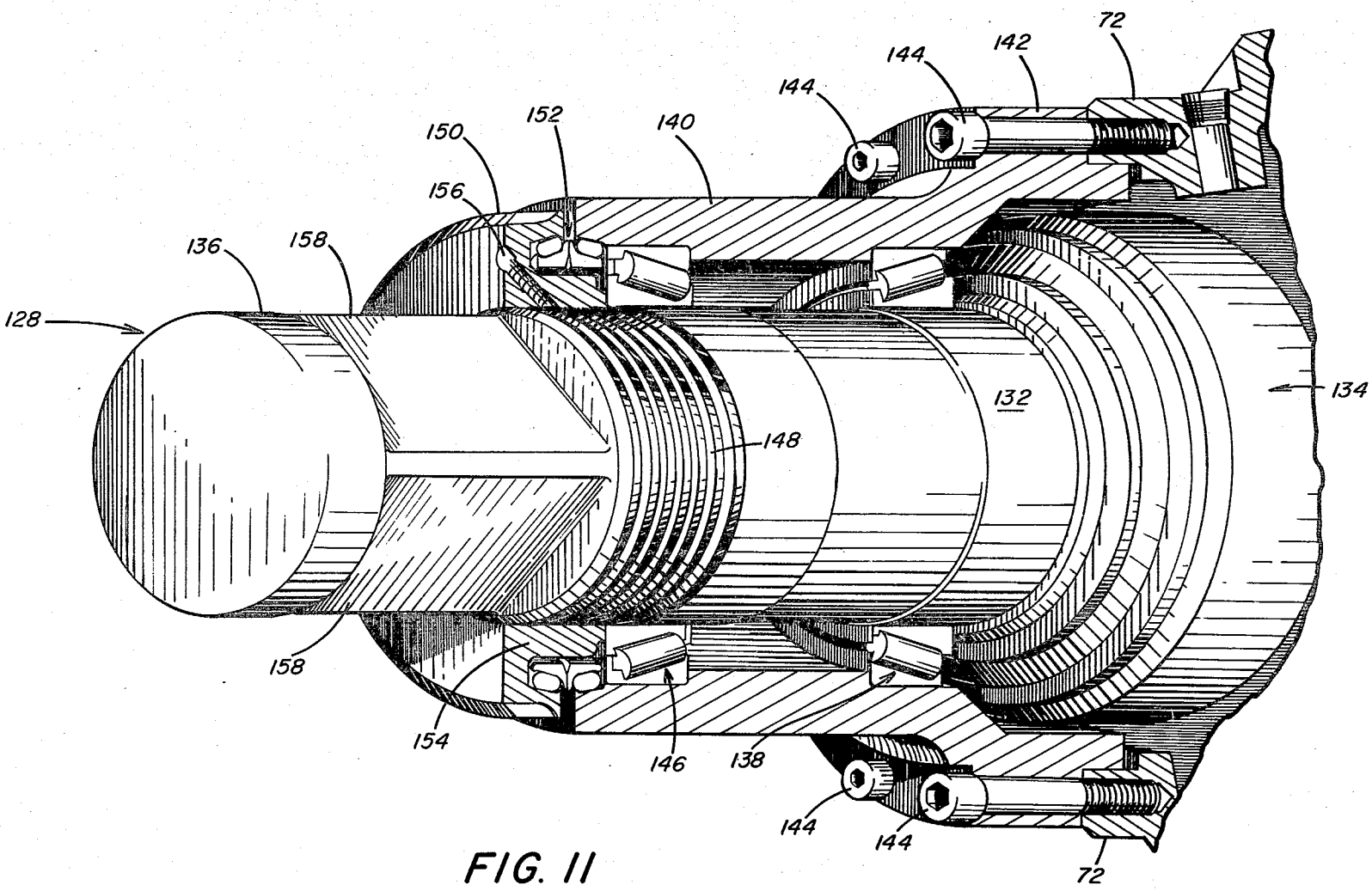
FIG. 11 is a fragmentary isometric view of one of the intermediate drum drive shafts extending from a respective end drum rotation, illustrating on the end of the drive shaft planar faces adapted for nonrotatable connection with the connecting plates of the intermediate drum section.

As illustrated in FIG. 11, the intermediate drive shaft 128 includes a first end portion 132 nonrotatably connected to a universal joint generally designated by the numeral 134 and a second end portion 136 which is adapted for nonrotatable connection to the drum housing sections 98 and 100 of the intermediate drum section 74. The universal joint 134 is nonrotatably connected to the end drum drive shaft 94 and is thereby operable to transmit rotation from the end drum drive shaft 94 to the intermediate drive shaft 128 to rotate the intermediate drum section 74. The details of a universal joint 134 operable for use in the present invention are disclosed in greater detail in U.S. Pat. No. 3,774,969 which is incorporated herein by reference.

The first end portion 132 of the intermediate drive shaft 128 is rotatably supported by a bearing assembly generally designated by the numeral 138 in FIG. 11. The bearing assembly 138 is supported by a bearing housing 140. The bearing housing 140 has a tubular construction with a flanged end portion 142 having a plurality of bores therethrough. The bores in end portion 142 are aligned with bores in the annular housing portion 72. A plurality of threaded bolts 144 extend through the aligned bores of the bearing housing 140 and the annular housing portion 72 to connect the bearing housing 140 to the annular housing portion 72. The intermediate drive shaft 128 is also rotatably supported within the bearing housing 140 by the bearing assembly generally designated by the numeral 146.

The intermediate drive shaft 128 includes a threaded portion 148, and an adjusting nut 150 is threadedly secured to the shaft threaded portion 148 to retain the bearing assembly 146 in position around shaft 128. A seal assembly generally designated by the numeral 152 surrounds a tubular portion 154 of adjusting nut 150 and is positioned between the adjusting nut 150 and the bearing housing 140 to provide a seal for the bearing assembly 146. A set screw 156 extends through the nut 150 into engagement with the shaft threaded portion 148.

Further as illustrated in FIG. 11, the portion of the intermediate drive shaft 128 between the threaded portion 148 and the second end portion 136 includes a plurality of planar faces 158. The planar faces are positioned at right angles to each other, as illustrated in FIG. 4. The planar faces 158 are adapted to drivingly engage the drum connecting assembly 130 to transmit rotation from the intermediate drive shaft 128 to the intermediate drum section 74.

The drum connecting assembly 130 includes a plurality of pairs of connecting plates 160 and 162. A single pair of connecting plates 160 and 162 is illustrated in FIG. 4. Preferably, a pair of connecting plates 160 and 162, as shown in FIG. 3, are positioned adjacent flared end portions 104 and 106 and are utilized to drivingly connect the intermediate drive shafts 128 to the intermediate drum section 74.

Figure 13:
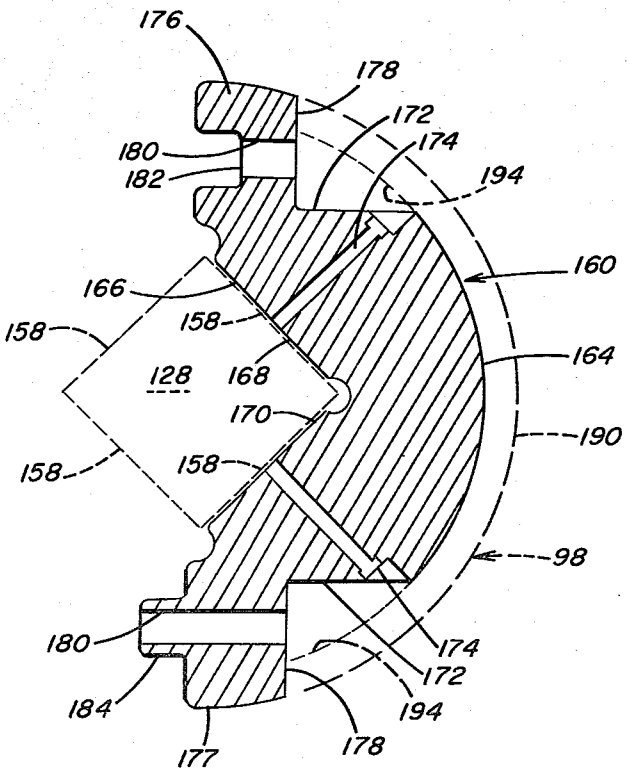
FIG. 13 is a sectional view of one of the connecting plates, illustrating the intermediate drum drive shaft by the dashed lines.
Figure 12:
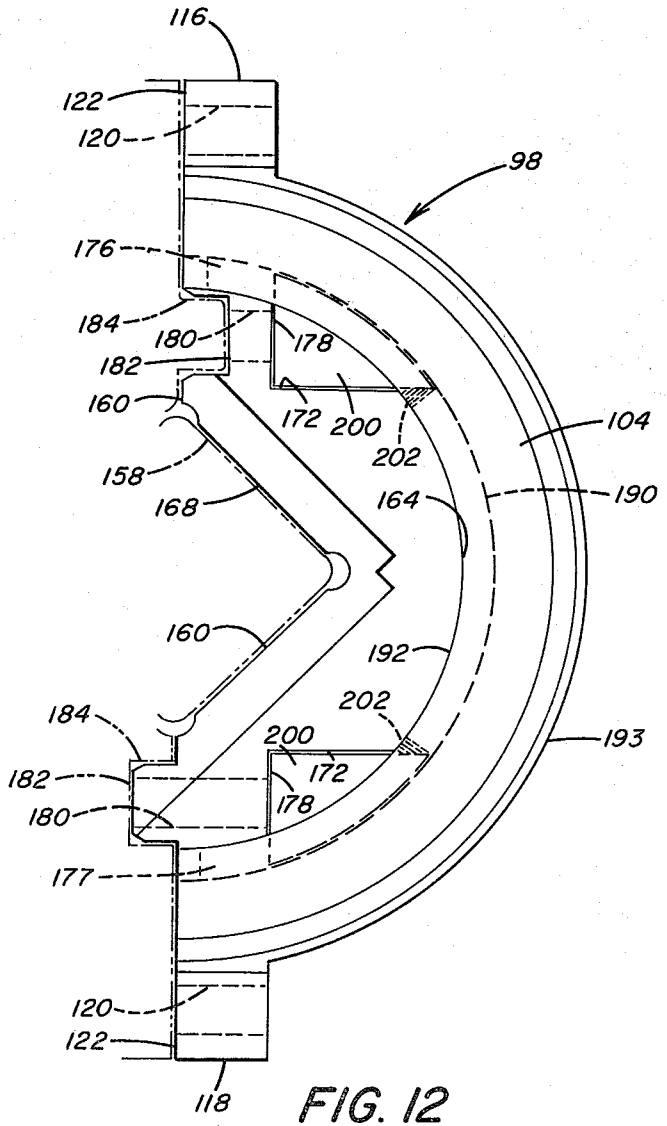
FIG. 12 is an enlarged end view representative of the first and second intermediate drum housing sections shown in FIGS. 5 and 8 with the cutting elements removed, illustrating the nonrotatable connection of a connecting plate to the drum housing section.

A pair of connecting plates 160 and 162 is adapted to be connected to each other in surrounding nonrotatable relation with the planar faces 158 of each intermediate drive shaft 128 extending from end drum sections 76 and 78. Each of the connecting plates 160 and 162 has a similar configuration and is connected in an identical manner to the respective drum housing sections 98 and 100. Therefore, the connecting plate 160 and corresponding drum housing section 98 illustrated in FIGS. 12 and 13 are similar to the corresponding connecting plate 162 and drum housing section 100. Therefore, the following description of the details of the connecting plate 160 and the drum housing section 98 is also applicable to the connecting plate 162 and drum housing section 100.

Now referring to FIGS. 5 and 7 and in greater detail to FIGS. 12 and 13, the connecting plate generally designated by the numeral 160 includes an arcuate surface 164 and a right-angled surface 166 formed by planar faces 168 and 170 that extend at right angles with respect to each other. The planar faces 168 and 170 are adapted to be positioned in abutting relation with the planar faces 158 of the intermediate drive shaft 128. In FIG. 12 the intermediate drive shaft planar faces 158 are indicated by the — - - — lines and in FIG. 13 by the - - - - lines.

The connecting plate arcuate surface 164 is bounded at the upper and lower ends thereof by edges 172. An opening 174 is provided in each edge 172 for the insertion of a grease fitting (not shown). The opening 174 extends through the plate 160 into communication with the planar face 158 of the intermediate drive shafts 128. Flange portions 176 and 177 extend from the edges 172 and form edges 178 that are perpendicular to the respective edges 172. A pair of spaced parallel bolt holes 180, only one of which is shown in FIGS. 12 and 13, extend through the flange portions 176 and 177. The bolt holes 180 are also shown in 5, 6, 8 and 9.

The flange portion 176 includes a recessed portion 182 that is aligned with the bolt holes 180. The flange portion 177 includes a protruding portion 184 through which the bolt holes 180 extend. Thus, with this arrangement as diagramatically illustrated in FIG. 12, the protruding portion 184 of connecting plate 162, indicated by the — - - — line, is arranged to extend into the recessed portion 182 of connecting plate flange portion 176. Similarly, at the opposite end of the connecting plates 160 and 162 the protruding portion 184 of connecting plate flange portion 177 is arranged to extend into the recessed portion 182 of connecting plate 162, indicated by the — - - — line of FIG. 12. In this manner the plate members 160 and 162 are positioned in assembled relation on the intermediate drive shaft 128 so that their planar faces 168 and 170 abut the planar faces 158 of the shaft 128.

With the pairs of connecting plates 160 and 162 positioned in this manner on the intermediate drive shafts 128, the respective bolt holes 180 of the plate members 160 and 162 are aligned to receive bolts 186, as illustrated in FIGS. 3 and 4. Nuts 188 are threaded on to the ends of the bolts 186 to securely clamp together the connecting plates 160 and 162 in surrounding nonrotatable relation on the drive shafts 128. With the plates 160 and 162 bolted together and the plate planar faces 168 and 170 abutting the shaft planar faces 158 the assembled connecting plates 160 and 162 are not rotatable on the shaft 128.

The connecting plates 160 and 162 are not only nonrotatably connected to the intermediate drive shafts 128 but are also nonrotatably connected to the respective drum housing sections 98 and 100. This arrangement is illustrated in FIGS. 5–10 and 12. Referring to FIG. 12 each of the drum housing sections 98 and 100 includes an outer arcuate surface 190 and an inner arcuate surface 194 on the center portion 102 and an outer arcuate surface 193 and an inner arcuate surface 192 on the flared end portions 104 and 106.

As illustrated in FIGS. 5, 6, 8, and 9 a first pair of openings 196 extend through the drum housing center portion 102. The openings 196 are vertically spaced from one another adjacent the end portion 108. Similarly, a second pair of openings 198 extend through the drum housing center portion 102. The openings 198 are vertically spaced from one another adjacent the end portion 110. A pair of the plate members 160 are positioned within the center portion 102 of the drum housing section 98 so that the connecting plate bolt holes 180 are positioned oppositely of the respective pair of openings 196 and 198 in the drum housing center portion 102. Similarly, a pair of the connecting plates 162 are positioned within the center portion 102 of drum housing section 100 so that the connecting plate bolt holes 180 are positioned oppositely of the respective pair of openings 196 and 198 in the drum housing center portion 102.

With the above arrangement, as illustrated in FIG. 12, the flange portions 176 and 177 of the connecting plates 160 and 162 extend into the openings 196 and 198 the full thickness of the center portions 102 between inner and outer surfaces 194 and 190. With this arrangement connecting plate flange portion 176 and 177 extend through the intermediate drum housing center portion 102. Also arcuate surface 164 of each connecting plate 160 and 162 abuts the arcuate inner surface 194 of the intermediate drum housing center portion 102. Consequently, in the assembled cutter drum the surfaces 164 of the connecting plates 160 and 162 engage the arcuate inner surfaces 194 of the respective center portions 102.

Positioned abutting the right-angled edges 172 and 178 on each side of the connecting plates 160 and 162 are side plates 200, as illustrated in FIGS. 5, 6, 8 and 9. The side plates 200 are positioned laterally of the openings 196 and 198 of each drum housing center portion 102 and abut the arcuate inner surface 194 thereof. The side plates 200 are secured to the respective connecting plates 160 and 162 by welding as indicated by weldments 201 in FIGS. 5, 6, 8 and 9. The connecting plates 160 and 162 are connected to the arcuate inner surface 194 of the respective center portions 102 by weldments 202, as illustrated in FIG. 12. In addition the connecting plates 160 and 162 are connected to the respective center portions 102 opposite the openings 196 and 198, as illustrated in FIGS. 6 and 9, by weldments 203. With this arrangement of the connecting plates 160 and 162 extending through the openings 196 and 198, the connecting plates 160 and 162 are nonrotatably connected to the center portions 102 of the drum housing sections 98 and 100 respectively.

With the above described arrangement the respective drum housing sections 98 and 100 of the intermediate drum section 74 are easily assembled and disassembled on the intermediate drive shafts 128 that extend from the end drum sections 76 and 78. In order to mount the drum sections 98 and 100 on the drive shafts 128, the connecting plates 160 and 162 being rigidly secured to the drum housing sections 98 and 100 are positioned in surrounding relation with the intermediate drive shafts 128. In the assembled position on the intermediate drive shafts 128, the abutment faces 122 of the drum housing section flange portions 116 and 118 are positioned in abutting relation. Also, the connecting plate planar surfaces 168 and 170 abut the drive shaft planar faces 158.

The oppositely positioned connecting plates 160 and 162 surrounding the drive shafts 128 are connected by extending the bolts 186 through the openings 196 and 198 and into the aligned bolt holes 180 and securing the nuts 188 on the threaded ends of the bolts 186. In this manner the connecting plates 160 and 162 are connected to one another for rotation with the intermediate drive shafts 128. The drum housing sections 98 and 100 are then connected by extending the bolts 124 through the bores 120 of the respective flange portions 116 and 118. The nuts 126 are threaded onto the bolts 124 to securely connect the drum housing sections 98 and 100. With this arrangement the connecting plates 160 and 162 rotate with the intermediate shafts 128 to, in turn, rotate the connected drum housing sections 98 and 100.

The arrangement of mounting the intermediate drum section 74 on the intermediate drive shafts 128 in accordance with the present invention substantially improves the efficiency of disassembling the intermediate drum section 74 for repair or replacement of the drum cutting elements generally designated by the numeral 204 in FIGS. 5–10. The cutting elements 204 are mounted on the respective drum housing sections 98 and 100 so that when the sections are connected to one another on the intermediate drive shafts 128, the cutting elements 204 of drum housing section 98 are coordinated with the cutting elements 204 on drum housing section 100 to form a continuous scroll or screw-type pattern around the periphery of the intermediate drum section 74.

The scroll pattern of the cutting elements 204 is operable upon rotation of the cutter drum assembly 42 to convey the dislodged material from the end drum sections 76 and 78 inwardly to the center of the intermediate drum section 74. From the center of the intermediate drum section 74, the dislodged material is fed rearwardly onto the gathering device 24. As illustrated in FIG. 1, the gathering device 24 includes gathering arms 206 that are oscillated with respect to one another to feed the dislodged material into the trough member 20 and onto the conveyer mechanism 18.

Referring in greater detail to the cutting elements 204, shown in FIGS. 5–10, each cutting element 204 includes a bit block 208 welded to the periphery of the intermediate drum section 74 and the end drum sections 76 and 78. A bit holder 210 is releasably connected to each bit block 208 by pin means (not shown). A cutter bit 212, is in turn, releasably connected to the bit holder 210 by pin means (not shown). With the present invention broken bit holders 210 and cutter bits 212 are efficiently replaced and if possible replaced in the field in order to minimize the downtime of the mining machine. However, in the event the bit blocks 208 break their replacement is difficult because the bit blocks are welded to the respective drum sections.

In most instances it is not possible to weld on a replacement bit block at the place of operation of the mining machine in a mine. In the past this has required either withdrawing the mining machine from its place of operation to a place where repairs can be made or by removing the particular drum section from the mining machine and taking the drum section to a suitable location for repairing. Disassembling the drum section from the drum assembly is the preferred practice because withdrawing the mining machine from its place of operation in the mine to make repairs results in a considerable reduction in the output of the mining machine.

With the present invention the respective drum sections and particularly the intermediate drum section 74 are easily disassembled in the field to facilitate repair of broken bit blocks 208. The downtime for repair can be further reduced by replacing damaged housing sections in the field. With the present invention replacement drum housing sections can be quickly mounted on the intermediate drive shafts 128 to return the mining machine to operation with a minimum of interruption in the mining operation. In most cases the assembly and disassembly of the drum housing sections 98 and 100 on the intermediate drive shafts 128 may take place at the mine face. Furthermore, the drum housing sections 98 and 100 can be disassembled without exposing the bearing seals 152 and loosing the lubricant.

According to the provisions of the Patent Statutes, we have explained the principle, preferred construction and mode of operation of our invention and have illustrated and described what we now consider to represent its best embodiments. However, it should be understood that, within the scope of the appended claims, the invention may be practiced otherwise that as specifically illustrated and described.

We claim:

1. A continuous mining machine comprising, a body portion, propelling means supporting said body portion for advancing said body portion, a boom member pivotally secured to said body portion and extending forwardly therefrom, a drum member rotatably mounted on the front of said boom member transversely to said body portion, said drum member having cutting elements extending therefrom, said cutting elements being arranged on said drum member to provide a continuous cutting pattern along the length of said drum member, said drum member having an intermediate drum section and a pair of end drum sections, said pair of end drum sections extending outwardly from the ends of said intermediate drum section respectively, drive means extending from said body portion for rotating said drum member, said drive means being nonrotatably connected to said pair of end drum sections, intermediate drum drive means extending from said drive means into said intermediate drum section for rotating said intermediate drum section, said intermediate drum drive means including a pair of intermediate drive shafts each having a first end portion drivingly connected to said pair of end drum sections respectively, said pair of intermediate drive shafts extending from said pair of end drum sections respectively into opposite ends of said intermediate drum section, said pair of intermediate drive shafts each having a second end portion positioned within said intermediate drum section, said intermediate drive shaft second end portions each having a plurality of planar surfaces positioned around the periphery of each intermediate drive shaft, drum connecting means being nonrotatably secured to said planar surfaces of said second end portions for transmitting rotation from said intermediate drive shafts to said intermediate drum section, means for rotatably supporting said intermediate drum drive means axially in said intermediate drum section, said intermediate drum section including a pair of housing sections positioned in surrounding relation with said intermediate drum drive means, means for releasably joining together said pair of housing sections in assembled relation around said intermediate drum drive means, and said drum connecting means being releasably positioned on said planar surfaces of said intermediate drive shaft second end portions.

2. A continuous mining machine as set forth in claim 1 in which, said drive means includes a pair of input drive shafts extending forwardly from said body portion and gear means positioned between said intermediate drum section and said pair of end drum sections respectively, and said gear means being drivingly connected to said pair of input drive shafts and to said pair of end drum sections respectively to transmit rotation thereto.

3. A continuous mining machine as set forth in claim 1 which includes, said pair of intermediate housing sections each having a center portion and a pair of flared end portions extending outwardly from said center portion, said center portion having a semicircular configuration, said flared end portions having flanges with bores extending therethrough, said center portions of said pair of intermediate housing sections being positioned in abutting relation and in surrounding relation with said intermediate drive means so that said flanges of said respective flared end portions are abutting and said bores are aligned, and said means for releasably joining together said pair of housing sections extending through said aligned bores to secure said pair of housing sections together.

4. A continuous mining machine as set forth in claim 1 in which, said drum connecting means includes a plurality of connected pairs of plate members positioned within said intermediate drum section, said plate members each including a first surface and a second surface, said first surface being secured to a respective one of said pair of housing sections, said second surface being adapted to engage said intermediate drum drive means, said intermediate drum housing sections being positioned around said intermediate drum drive means so that said plate members of one of said housing sections abut said plate members of the other of said housing sections to form pairs of said plate members surrounding said intermediate drum drive means, and means for releasably connecting said pairs of abutting plate members to nonrotatably secure said pairs of abutting plate members to said intermediate drum drive means.

5. A mining machine cutter drum assembly comprising, a drum member having cutting elements extending therefrom, said cutting elements being arranged on said drum members to provide a continuous cutting pattern along the length of said drum member, said drum member including an intermediate section and a pair of end drum sections, said pair of end drum sections extending outwardly from the ends of said intermediate drum section respectively, drive means for rotating said drum member, said drive means including a pair of intermediate drive shafts each having a first end portion drivingly connected to said pair of end drum sections respectively and a second end portion positioned within said intermediate drum section, said second end portions having a plurality of planar driving faces, means for rotatably supporting said intermediate drive shaft second end portions axially in said intermediate drum section, said intermediate drum section having a split construction to form a pair of separate housing sections having opposed planar surfaces positioned in surrounding relation with said intermediate drum drive means, means for releasably joining together said pair of housing sections in assembled relation around said intermediate drum drive means, drum connecting means secured to said pair of housing sections for drivingly connecting said pair of housing sections to said intermediate drum drive means, and said drum connecting means having a plurality of planar driving faces connected in complimentary engagement with said planar driving faces of said intermediate drive shafts to transmit rotation from said intermediate drum drive means to said intermediate drum section.

6. A mining machine cutter drum assembly as set forth in claim 5 which includes, said pair of intermediate housing sections each having a center portion and a pair of flared end portions extending outwardly from said center portion, said center portion having a semicircular configuration, said flared end portions having flanges with bore extending therethrough, said center portion of said pair of intermediate housing sections being positioned in abutting relation and in surrounding relation with said intermediate drive means so that said flanges of said respective flared end portions are abutting and said bores are aligned, and said means for releasably joining together said pair of housing sections extending through said aligned bores to secure said pair of housing sections together.

7. A mining machine cutter drum assembly as set forth in claim 5 in which, said drum connecting means includes a plurality of connected pairs of plate members positioned within said intermediate drum section, said plate members each including a first surface and a second surface, said first surface being secured to a respective one of said pair of housing sections, said second surface being formed by a pair of said planar driving faces extending at right angles with respect to each other, said planar driving faces of said second end portions of said intermediate drive shafts extending at right angles with respect to each other for complimentary, nonrotatable engagement with said drum connecting means planar driving faces, said intermediate drum housing sections being positioned around said intermediate drum drive means so that said plate members of one of said housing sections abut said plate member of the other of said housing sections to form pairs of said plate members surrounding said intermediate drum drive means, and means for releasably connecting said pairs of abutting plate members to nonrotatably secure said pairs of abutting plate members to said intermediate drum drive means.

8. A continuous mining machine comprising, a body portion, propelling means supporting said body portion for advancing said body portion, a boom member pivotally secured to said body portion and extending forwardly therefrom, a drum member rotatably mounted on the front of said boom member transversely to said body portion, said drum member having cutting elements extending therefrom, said cutting elements being arranged on said drum member to provide a continuous cutting pattern along the length of said drum member, said drum member having an intermediate drum section and a pair of end drum sections, said pair of end drum sections extending outwardly from the ends of said intermediate drum section respectively, drive means extending from said body portion for rotating said drum member, said drive means being nonrotatably connected to said pair of end drum sections, intermediate drum drive means extending from said drive means into said intermediate drum section for rotating said intermediate drum section, means for rotatably supporting said intermediate drum drive means axially in said intermediate drum section, said intermediate drum section including a pair of housing sections positioned in surrounding relation with said intermediate drum drive means, each of said housing sections having a center portion and a pair of flared end portions extending outwardly from said center portion, said center portion having a semicircular configuration, said flared end portions having flanges with bores extending therethrough, said center portions of said pair of intermediate housing sections being positioned in abutting relation and in surrounding relation with said intermediate drive means so that said flanges of said respective flared end portions are abutting and said bores are aligned, means for releasably joining together said pair of housing sections in assembled relation around said intermediate drum drive means, said means extending through said aligned bores to secure said pair of housing sections together, drum connecting means secured to said pair of housing sections for drivingly connecting said pair of housing sections to said intermediate drum drive means, and said drum connecting means being releasably positioned on said intermediate drum drive means to transmit rotation from said intermediate drum drive means to said intermediate drum section.

9. A continuous mining machine as set forth in claim 8 in which, said intermediate drum drive means includes a pair of intermediate drive shafts each having a first end portion drivingly connected to said pair of end drum sections respectively, said pair of intermediate drive shafts extending from said pair of end drum sections respectively into opposite ends of said intermediate drum section, said pair of intermediate drive shafts each having a second end portion positioned within said intermediate drum section, said intermediate drive shaft second end portions each having a plurality of planar surfaces positioned around the periphery of each intermediate drive shaft, and said drum connecting means being nonrotatably secured to said planar surfaces of said second end portions for transmitting rotation from said intermediate drive shafts to said intermediate drum section.

10. A continuous mining machine as set forth in claim 8 in which, said drive means includes a pair of input drive shafts extending forwardly from said body portion and gear means positioned between said intermediate drum section and said pair of end drum sections respectively, said gear means being drivingly connected to said pair of input drive shafts and to said pair of end drum sections respectively to transmit rotation thereto, said intermediate drum drive means including a pair of intermediate drive shafts drivingly connected at one end to said pair of end drum sections respectively, said pair of intermediate drive shafts extending from said pair of end drum sections respectively into opposite ends of said intermediate drum section, and said intermediate drive shafts being nonrotatably connected to said drum connecting means to thereby transmit rotation from said pair of end drum sections to said intermediate drum section.

11. A continuous mining machine as set forth in claim in which, said drum connecting means includes a plurality of connected pairs of plate members positioned within said intermediate drum section, said plate members each including a first surface and a second surface, said first surface being secured to a respective one of said pair of housing sections, said second surface being adapted to engage said intermediate drum drive means, said intermediate drum housing sections being positioned around said intermediate drum drive means so that said plate members of one of said housing sections abut said plate members of the other of said housing sections to form pairs of said plate members surrounding said intermediate drum drive means, and means for releasably connecting said pairs of abutting plate members to nonrotatably secure said pairs of abutting plate members to said intermediate drum drive means.

12. A continuous mining machine comprising, a body portion, propelling means supporting said body portion for advancing said body portion, a boom member pivotally secured to said body portion and extending forwardly therefrom, a drum member rotatably mounted on the front of said boom member transversely to said body portion, said drum member having cutting elements extending therefrom, said cutting elements being arranged on said drum member to provide a continuous cutting pattern along the length of said drum member, said drum member having an intermediate drum section and a pair of end drum sections, said pair of end drum sections extending outwardly from the ends of said intermediate drum section respectively, drive means extending from said body portion for rotating said drum member, said drive means being nonrotatably connected to said pair of end drum sections, intermediate drum drive means extending from said drive means into said intermediate drum section for rotating said intermediate drum section, means for rotatably supporting said intermediate drum drive means axially in said intermediate drum section, said intermediate drum section including a pair of housing sections positioned in surrounding relation with said intermediate drum drive means, means for releasably joining together said pair of housing sections in assembled relation around said intermediate drum drive means, drum connecting means secured to said pair of housing sections for drivingly connecting said pair of housing sections to said intermediate drum drive means, said drum connecting means including a plurality of connected pairs of plate members positioned within said intermediate drum section, said plate members each including a first surface and a second surface, said first surface being secured to a respective one of said pair of housing sections, said second surface being adapted to engage said intermedi said intermediate drum housing sections being positioned around said intermediate drum drive means so that said plate members of one of said housing sections abut said plate members of the other of said housing sections to form pairs of said plate members surrounding said intermediate drum drive means, and said pairs of abutting plate members being releasably connected to nonrotatably secure said pairs of abutting plate members to said intermediate drum drive means.

13. A continuous mining machine as set forth in claim 12 in which, said drive means includes a pair of input drive shafts extending forwardly from said body portion and gear means positioned between said intermediate drum section and said pair of end drum sections respectively, said gear means being drivingly connected to said pair of input drive shafts and to said pair of end drum sections respectively to transmit rotation thereto, said intermediate drum drive means including a pair of intermediate drive shafts drivingly connected at one end to said pair of end drum sections respectively, said pair of intermediate drive shafts extending from said pair of end drum sections respectively into opposite ends of said intermediate drum section, and said intermediate drive shafts being nonrotatably connected to said drum connecting means to thereby transmit rotation from said pair of end drum sections to said intermediate drum section.

14. A continuous mining machine as set forth in claim 12 in which, said intermediate drum drive means includes a pair of intermediate drive shafts each having a first end portion drivingly connected to said pair of end drum sections respectively, said pair of intermediate drive shafts extending from said pair of end drum sections respectively into opposite ends of said intermediate drum section, said pair of intermediate drive shafts each having a second end portion positioned within said intermediate drum section, and said intermediate drive shaft second end portions each having a plurality of planar surfaces positioned around the periphery of each intermediate drive shaft.

15. A continuous mining machine as set forth in claim 12 which includes, said pair of intermediate housing sections each having a center portion and a pair of flared end portions extending outwardly from said center portion, said center portion having a semicircular configuration, said flared end portions having flanges with bores extending therethrough, said center portions of said pair of intermediate housing sections being positioned in abutting relation and in surrounding relation with said intermediate drive means so that said flanges of said respective flared end portions are abutting and said bores are aligned, and said means for releasably joining together said pair of housing sections extending through said aligned bores to secure said pair of housing sections together.

* * * * *